US005327962A

United States Patent [19]

Head

[11] Patent Number: 5,327,962

[45] Date of Patent: Jul. 12, 1994

[54] WELL PACKER

[76] Inventor: Philip F. Head, 6 Leith Mansions, Grantully Road, London W9 1LQ, United Kingdom

[21] Appl. No.: 926,869

[22] Filed: Aug. 6, 1992

[30] Foreign Application Priority Data

Aug. 16, 1991 [GB] United Kingdom ..... 9117683.4

[51] Int. Cl.[5] ..... E21B 33/127

[52] U.S. Cl. ..... 166/187; 277/34; 277/DIG. 6

[58] Field of Search ..... 166/187, 135, 179, 192; 277/DIG. 6, 34, 235 R

[56] References Cited

U.S. PATENT DOCUMENTS 2,221,775 11/1940 Boynton ..... 166/187 X
3,028,915 4/1962 Jennings ..... 166/187 X
3,047,065 7/1962 Vincent ..... 166/187 X
3,054,455 9/1962 Keltner ..... 166/187
3,529,667 9/1970 Malone ..... 166/187 X
4,357,992 11/1982 Sweeney ..... 166/187 X

*Primary Examiner*—Stephen J. Novosad
*Attorney, Agent, or Firm*—Herbert Dubno

[57] ABSTRACT

An inflatable well packer includes several annular layers of material, consisting of a series of oriented fibers encapsulated in an elastomeric resin, the inner and outer circumferential surfaces of the well packer each carry a protective layer of material effective to protect the elastomeric resin, each protective layer 9, 11 is deposited on the well packer in a folded configuration, such that unfolding of the layers enables inflation of the well packer.

12 Claims, 14 Drawing Sheets

WELL PACKER

FIELD OF THE INVENTION

This invention relates to well packers. In particular, the invention relates to inflatable well packers, which in use are inflated by fluid under pressure to isolate a zone in a well.

BACKGROUND OF THE INVENTION

Inflatable well packers have been known for many years, the packers being used to isolate a zone in a well, so as, for example to enable a drill stem test to be performed, to perform a selective chemical treatment, or to isolate a redundant zone in a productive well. There are presently two types of inflatable well packers, each being of a multi-layered construction including an elastomeric inner bladder, but varying in the stress bearing system incorporated in the packer. The first type of known well packer includes wire or textile fibres, woven together with their ends secured to end fittings by an epoxy potting process, the sheath of woven wire or fibres being covered in an outer elastomeric boot which will form the hydraulic seal to the casing, or open-hole surface of a well which the well packer will, in use isolate. The other type of inflatable well packer utilises long, peripherally overlapping strips of spring steel which, when the packer is inflated, slide radially against each other like venetian blinds, the strips surrounding the elastomeric inner bladder. The central portions of the strips are bonded to an outer annular elastomeric boot which acts as a hydraulic seal to the casing or open-hole surface in use of the well packer. An example of a well packer of this type is shown in U.S. Pat. No. 3,160,211.

With either of these known well packers there are a number of shortcomings. Firstly, the manufacture of either of these well packers is labour intensive. In the case of the woven sheath reinforced well packer, the reinforcing wire or fabric has to be hand-woven during assembly of the well packer. In the case of the spring steel strip reinforced well packer, the large number of overlapping strips are difficult to assemble and engage in their end fittings.

Furthermore, in either of the known types of well packers, the elastomeric inner bladder has to expand typically by twice the amount that the outer elastomeric boot has to expand. Thus, if the packer has to be inflated by a ratio of 3:1 in order for the outer boot to make the required seal, the inner elastomeric bladder will have to expand by a ratio of 6:1. This results in the inner elastomeric bladder in its inflated state being very thin, thus making the inner elastomeric bladder susceptible to any micro faults which it may have in its structure. Furthermore, the high expansion ratio required by the inner elastomeric bladder severely limits the choice of materials which may be used. As a result of the limited choice of materials, the inner elastomeric bladder tends to have a very limited chemical resistance to any fluid other than water, thus limiting the life of the packer when the packer is exposed to fluids such as acids, solvents, diesel oil, and surfactants, these all being chemicals which are commonly required for treatments of zones within wells.

With regard to the outer elastomeric boot included in either type of known well packers, although this only has to typically expand by a ratio of 3:1, and thus an increased choice of materials enables it to have a better chemical resistance to the fluids used in the wells than that of the inner elastomeric bladder, the outer elastomeric boot still has a relatively short life span.

OBJECTS OF THE INVENTION

It is an object of the present invention to provide a well packer overcoming drawbacks of the described types of a well packer.

Still another object is to provide the well packer including a protective layer which can be resistant to detrimental effect of the surrounding chemical environment and yet another object is to provide a method of making the well packer.

SUMMARY OF THE INVENTION

According to a first aspect of the present invention there is provided an inflatable well packer comprising an annular member including a quantity of a flexible material and a stress bearing system, the annular member being such that pressure from the bore of the annular member causes inflation of the well packer, wherein the inner and outer circumferential surfaces of the annular member each carry a protective layer of material effective to protect the flexible material from the surrounding chemical environment.

The flexible material will generally be an elastomeric resin.

The protective layers of material suitably comprise metal foils preferably in the form of a laminated layer of materials highly resistant to corrosion.

Preferably the protective layers are deposited on the inner and outer circumferential surfaces in a folded configuration. Alternatively, the protective layers may be deposited on the inner and outer circumferential surfaces in a twisted configuration. Thus the protective layers may have different expansion properties to those of the flexible material, the necessary expansion of the layers when the packer is expanded being at least partially produced by an unfolding or untwisting of the protective layers.

In a preferred embodiment in accordance with the invention, the annular member comprises at least one annular layer of material comprising a series of fibres encapsulated in the flexible material, at least a portion of the annular layer of material being corrugated along the direction of the circumference of the layer, the layer being designed such that pressure from the bore of the annular member causes at least partial unfolding of the corrugations, thereby causing inflation of the well packer.

According to a second aspect of the present invention, there is provided a method of making an inflatable well packer, including the steps of forming a first protective layer over a mandrel; forming an annular member, including a quantity of a flexible material and a stress bearing system, over the first protective layer; and forming a second protective layer over the annular member, the first and second protective layers being effective to protect the flexible material from the surrounding chemical environment.

Preferably at least part of the flexible material is injected into a mould, defined by the second protective layer and part of the annular member.

The first and second protective layers are suitably formed in a folded configuration, either by extending the material forming the layers through a die, or alternatively mechanically folding the layers. Such mechanical folding of the layers may be achieved by forming each layer into the shape of a tube, and mechanically folding regions of the tube.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
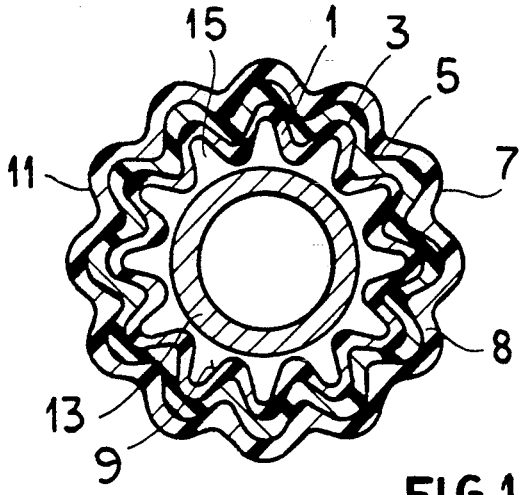
FIG. 1 is a schematic cross-section of a first well packer in accordance with an embodiment of the invention, the well packer being shown in an uninflated state.

Referring firstly to FIG. 1, the first embodiment of the well packer to be described, comprises four concentric corrugated layers 1,3,5,7 of reinforcing fibers encapsulated in an elastomeric resin system 8 (although conventional unribbed layers could also be used). The two edges of the layers 1,3,5,7 are secured by respective end fittings, not shown. Conventional end fittings such as are well known in the art can be used to secure the ends of the layers.

On the inner surface of the innermost layer 1 and the outer layer of the outermost surface 7, there are carried respective protective layers 9,11. The layers 9,11 each comprise a material having a high chemical resistance to oil well fluids and the fluids which are pumped into reservoir zones, examples of a suitable material being most metals and selected fluoroplastics such as "TEFLON" or "RYTON". Alternatively, the layers may be formed from other materials having suitably high chemical resistance properties, for example polyphenylene sulphide which is sold under the trade names "RYTON" and "SUPEC." The well packer shown in FIG. 1 is installed on a running tool mandrel 13, a space 15 being defined between the outer surface of the mandrel 13 and the protective layer 9.

Figure 2:
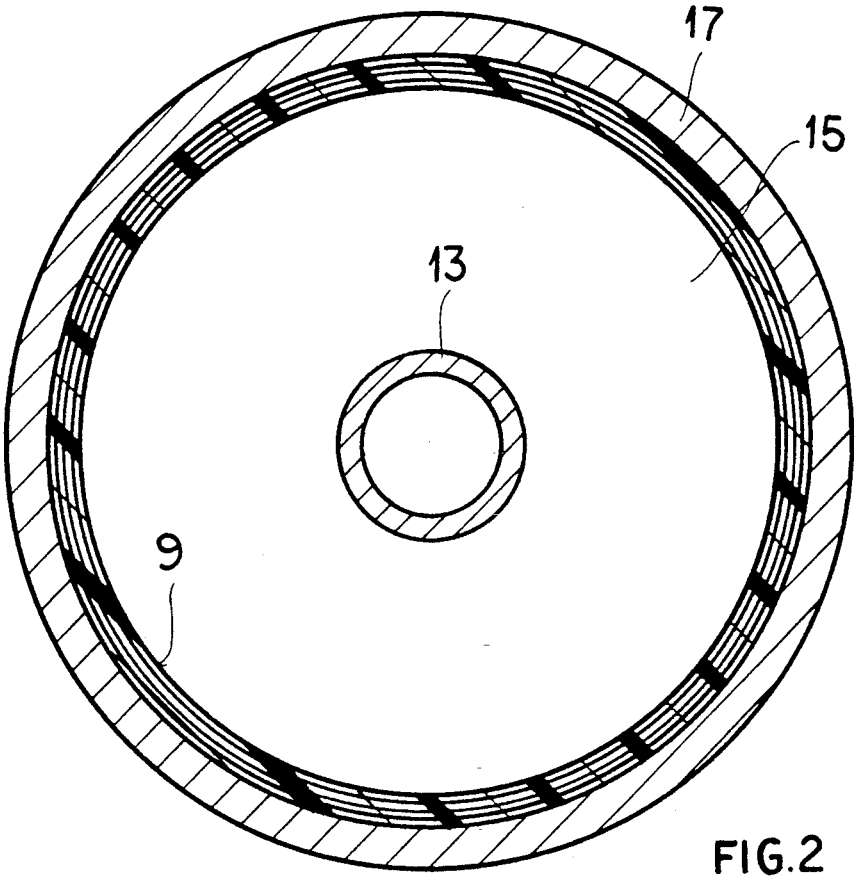
FIG. 2 is a schematic cross-section of the well packer of FIG. 1 in an inflated state.
Figure 1A:
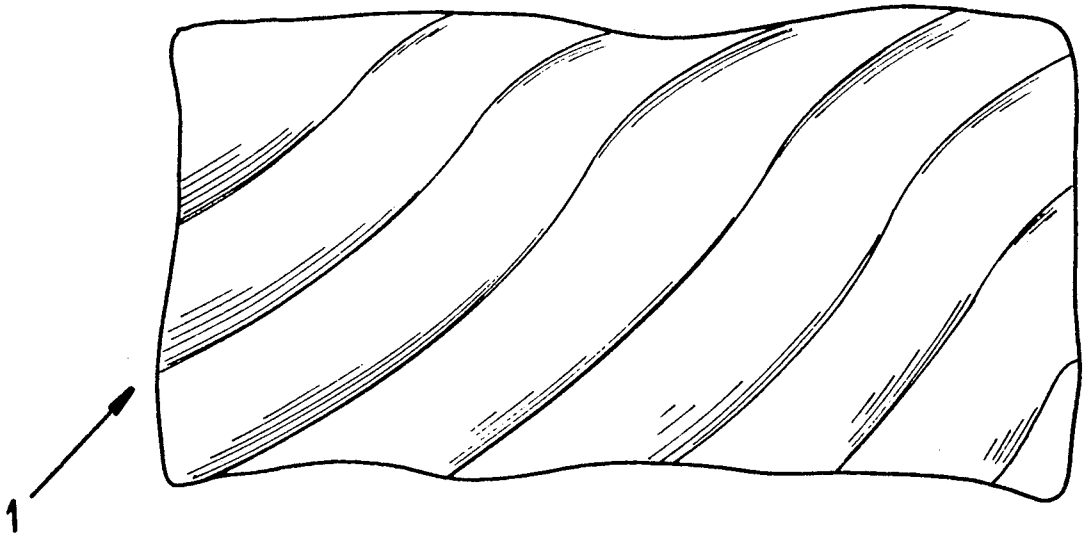
FIG. 1A is a schematic cross-section of the expanded well with the barrier over layer partially twisted with respect to the sleeve.

Referring now to FIG. 2, in use of the well packer the packer is inserted in the core of a well, or in a casing such as a cylindrical steel casing, only the lining 17 of the casing being shown in the figure. To inflate the well packer, fluid is pumped into the space 15 between the mandrel 13 and the inner protective layer 9, until the outer protective layer 11 conforms to the inner surface of the lining 17 of the steel casing, the unwinding of the corrugations in the layers 1,3,5,7 enabling the expansion of the well packer. Thus the corrugations enable the well packer to expand without relying totally on the elastic expansion of the elastomeric resin. It is particularly important to ensure that the outer and innermost protective layers 9, 11 are securely sealed to the end fittings to ensure that no corrosive elements penetrate into the inner layers of the packer.

Figure 3:
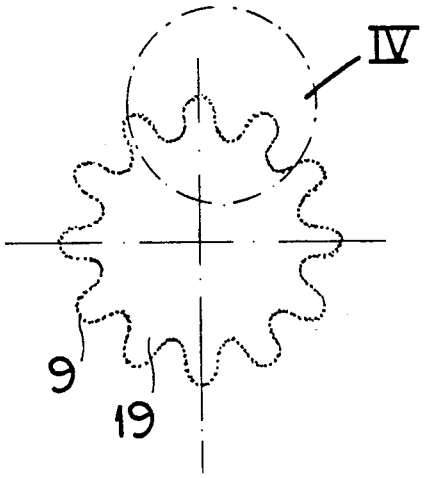
FIG. 3 is a schematic end-sectional view of a disposable inner mandrel used in a first stage of the method of manufacture of the well packer of FIG. 1.
Figure 4:
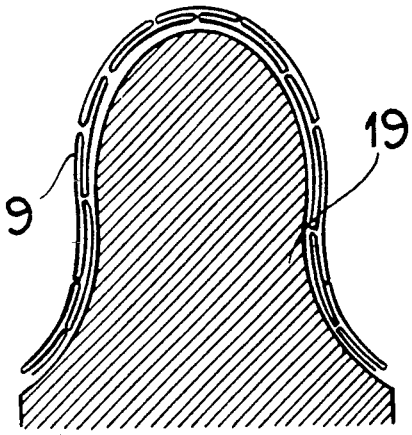
FIG. 4 is a detail of FIG. 3.
Figure 5:
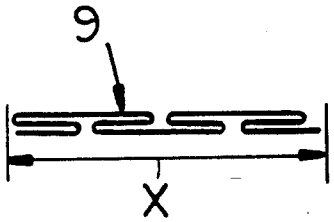
FIG. 5 illustrates schematically part of a protective layer wound round the mandrel of FIG. 3 laid on a flat surface.
Figure 6:
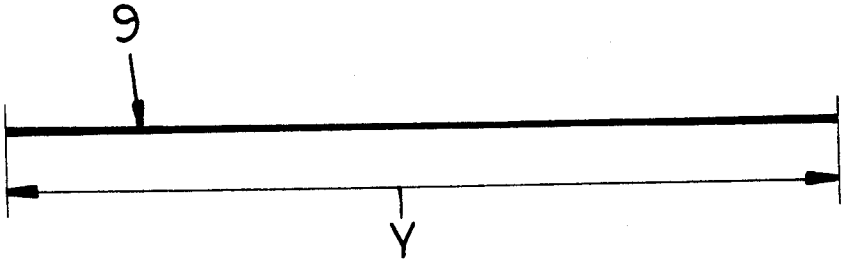
FIG. 6 is the part layer of FIG. 5 pulled out into a single planar surface.
Figure 7:
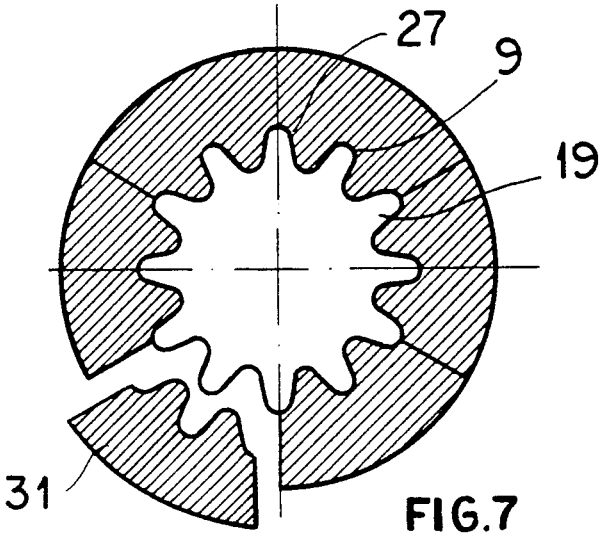
FIG. 7 is outer mould places being placed round the disposable mandrel of FIG. 3.

Referring now to FIG. 3, in order to manufacture the well packer shown in FIGS. 1 and 2, the inner protective layer 9 is laid around a disposable or reusable mandrel 19, as shown in more detail in FIG. 4. As can be seen in FIG. 5, the layer 9 has a folded configuration, the layer 11 being of a similar configuration, this thus increasing the effective length of the layers 9, 11 within the packer by the ratio $X \times X \times Y$ where X and Y are the distances indicated in FIGS. 6 and 5 respectively. This folded configuration can be produced by extruding the raw material through a die. Alternatively, the folded configuration of layers 9,11 can be produced mechanically, by forming the layers 9,11 into tubes each having a diameter equivalent to the respective diameters that the layers 9,11 will have when the packer is inflated, and then performing a mechanical folding operation on the tubes. The layers 9,11 are designed so that when the well packer has inflated as shown in FIG. 2, the folds are at least partially removed. In a preferred embodiment the layers 9,11 have memory properties, such that when the well packer returns to its unextended configuration, when the pressure inside the packer is reduced, the layers resume their folds once more.

This can be achieved by including short fibers in the layers 9,11 at the time of extrusion of the raw material used to produce the layers 9,11 through a die. Suitable fibers for this purpose are glass fibers, or short KEVLAR fibers.

It will be appreciated that in a well packer in accordance with the invention, the protective layers 9,11 act as the internal pressure containment barrier, and also form the external hydraulic seal to the surface of the bore or casing into which the packer is inserted. Thus the temperature and differential pressure limits for the well packer are increased.

Figure 8:
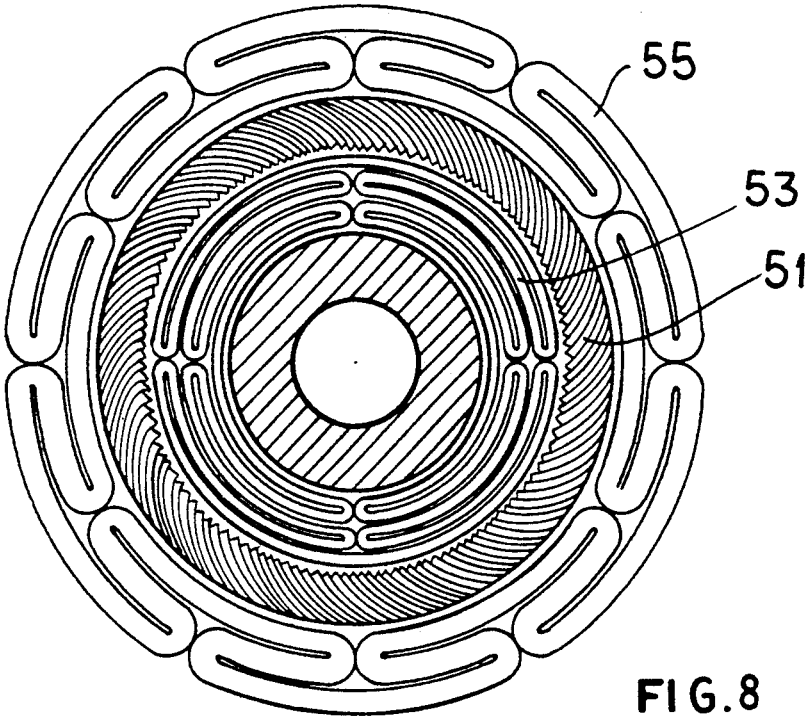
FIG. 8 is a schematic cross-section of a second well packer in accordance with an embodiment of the invention.
Figure 9:
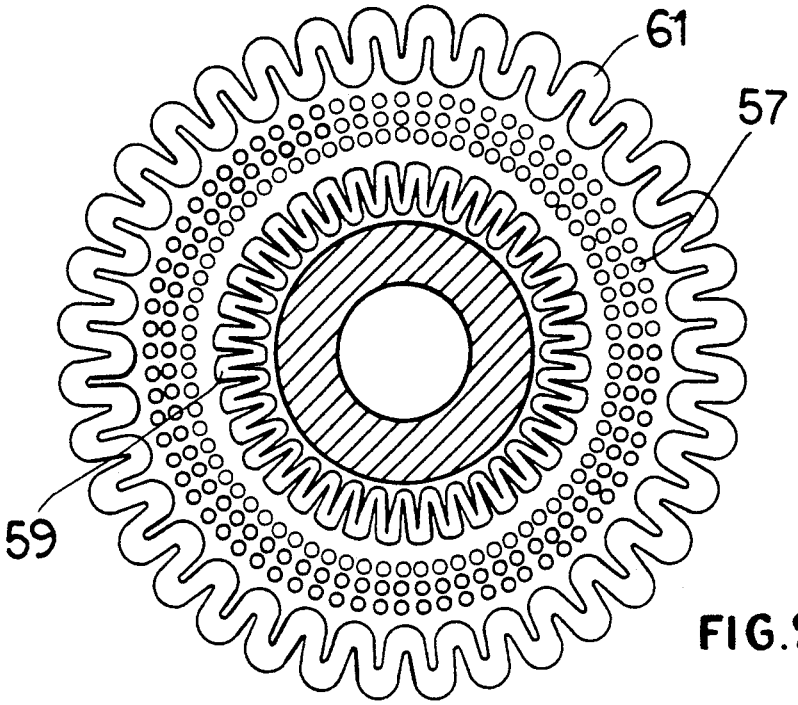
FIG. 9 is a schematic cross-section of a third well packer in accordance with an embodiment of the invention.

It will also be appreciated that, while a well packer in accordance with the invention has particular application a ribbed well packer described, a well packer in accordance with the present invention has equal application to well packers which do not incorporate the corrugated reinforcing layers shown in my co-pending application, but incorporate alternative forms of stress-bearing systems. Examples of well packers in accordance with the invention incorporating such alternative forms of stress-bearing systems are shown in FIGS. 8 and 9. Referring firstly to FIG. 8, this figure shows a cross section of a well packer in which the stress bearing system is of the type including long, peripherally overlapping strips of spring steel 51. The inner 53 and outer 55 protective layers are formed of layers of material which are folded back on themselves to form folds around the inner and outer circumferential surfaces of the stress-bearing system 51. Expansion of the well packer is thus enabled by the sliding over each other of the strips of spring steel 51 and the unfolding of the folds of the layer 53,55 as the packer inflates.

Referring now to FIG. 9, the third well packer in accordance with yet another embodiment of the invention to be described, includes a braided wire type stress bearing system 57. Inner 59 and outer 61 protective layers are formed in the inner and outer circumferential surfaces of the braided wire 57, with radially directed folds, which, during inflation of the well packer, unfold to accommodate the expansion of the well packer.

In a further advantageous embodiment of the invention a suitable material which can transmit pressure such as a suitable liquid or silicone is present between the inner layers 1, 53, 59 and the other layers 3, 55, 61 of the packer respectively. This material would help to prevent the build up of hydrostatic pressure between the inner and outer layers and the main body of the packer. This allows the folds or corrugations in the inner and outer layers to unfold easily and avoids pinching of the folds which would prevent the layers from unfolding.

It will be appreciated that in each of the well packers in accordance with embodiments of the invention, inflation of the well packer is enabled by folding the layer of material forming the inner and outer protective layers, the necessary expansion of the layers on inflation of the well packer can be achieved by twisting a tubular layer over the inner and outer circumferential surfaces of the stress bearing system, the tubular layer having a larger circumference than the circumferential surfaces. Thus, partial untwisting of the tubular layers as the packer inflates, will cause at least part of the necessary expansion of the layers.

It will also be appreciated that while it is advantageous to enable expansion of the protective layers on inflation of the packer, without relying totally on the elastic expansion properties of the material forming the protective layers, materials for the protective layers may be chosen which at least partially accommodate the inflation of the packer by virtue of their inherent elastic properties. For example, some grades of TEFLON have an elastic elongation before their elastic limit is reached. Thus by use of these materials, the need for folded or twisted protective layers may be avoided. Where, however, polyphenylene sulphide, for example Ryton or Supec, is used for the protective layers, in view of the more limited elastic properties of these materials, it will be necessary to form the protective layers in a folded or twisted configuration to achieve nearly all the necessary expansion.

I claim:

1. An inflatable packer comprising:

an expandable elongated sleeve extending along a longitudinal axis, said sleeve being formed with at least one circumferentially expandable portion formed with: at least one annular first layer of an elastomeric resin having outer and inner circumferences, and two barrier annular layers coaxial with the first layer, each of the barrier layers lying against a respective one of the inner and outer circumferences of the first layer, said barrier layers being of material relatively inert to the corrosive fluids present in a well and selected from the group consisting of metals, fluoroplastics and polyphenylene sulphide, said sleeve being formed with an inner bore, said portion being expandable from a deflated condition to an inflated condition to form a seal upon building up of pressure in the bore, each barrier layer being impermeable and preventing contact between the respective circumference of the first layer and the corrosive fluids present in the well in the inflated condition position of said portion; and spreading means for enabling each barrier layer to spread from a respective initial configuration upon building up the pressure in the bore, each barrier layer being contractable substantially to the respective initial configuration upon reduction of the pressure in the bore.

2. The inflatable packer defined in claim 1 wherein the spreading means includes folds or ribs formed at least on a porion of each barrier layer.

3. The inflatable packer according to claim 2, wherein the folds or ribs are formed in a direction generally perpendicular to the circumference of the packer.

4. The inflatable packer defined in claim 2 wherein the folds are formed by deformation of the respective barrier layer less than 90° to a tangent plane thereof in the deflated condition.

5. The inflatable packer according to claim 1, wherein at least a portion of the expandable portion comprises folds or ribs.

6. The inflatable packer according to claim 1 wherein each spreading means includes at least a portion of the respective barrier layer which is at least partially twisted with respect to the expandable portion.

7. The inflatable packer according to claim 1, wherein each barrier layer comprises a metal sheet.

8. The inflatable packer according to claim 1, wherein each barrier layer comprises a laminated layer.

9. The inflatable packer according to claim 1, further comprising a layer of pressure transmitting material between the barrier layers and the first layer.

10. The inflatable packer according to claim 9 wherein the pressure transmitting material comprises a liquid.

11. The inflatable packer according to claim 9, wherein the pressure transmitting material comprises silicone.

12. The inflatable packer defined in claim 1 wherein each barrier layer is permanently fixed to the first layer.

* * * * *